US006616379B1

(12) United States Patent
Paulsen et al.

(10) Patent No.: US 6,616,379 B1
(45) Date of Patent: Sep. 9, 2003

(54) MARINE CAISSON BRACING SYSTEM AND METHOD OF INSTALLATION

(75) Inventors: Dwight C. Paulsen, Slidell, LA (US); Paul G. Haddican, Marrero, LA (US); Ernest M. Posner, III, Madisonville, LA (US); Randy J. Tingstrom, Kenner, LA (US); Tara L. Mays, Kenner, LA (US)

(73) Assignee: EDG, Inc., Metairie, LA (US)

( * ) Notice: Subject to any disclaimer, the term of this patent is extended or adjusted under 35 U.S.C. 154(b) by 0 days.

(21) Appl. No.: 10/093,189

(22) Filed: Mar. 7, 2002

(51) Int. Cl.[7] ..... E02D 29/00; E02B 17/08
(52) U.S. Cl. ..... 405/195.1; 405/203
(58) Field of Search ..... 405/195.1, 203, 405/204, 224, 227, 228; 254/334, 338

(56) References Cited

U.S. PATENT DOCUMENTS 4,000,624 A * 1/1977 Chow ..... 405/204
4,148,465 A * 4/1979 Bowman ..... 254/334
4,818,145 A 4/1989 Carruba
5,026,210 A 6/1991 Carruba
5,181,799 A 1/1993 Carruba
5,308,194 A 5/1994 Carruba

* cited by examiner

*Primary Examiner*—Heather Shackelford
*Assistant Examiner*—Lisa Saldano
(74) *Attorney, Agent, or Firm*—Joseph T Regard Ltd

(57) ABSTRACT

A bracing structure is provided in the form of an elongated bracing member having first and second ends, the first end having a pile sleeve for engaging the bottom, the second end having a doubler plate or the like for engaging a caisson above the water line. A pulley may be provided on the caisson above the water line, in the vicinity of where the doubler plate is to be mounted on the caisson. A cable having first and second ends is provided, the first end affixed to the bracing member in the vicinity of the doubler plate, the second end engaging the tugger or winch. In use, the tugger draws the cable so as to urge the doubler plate to the caisson above the water line in the vicinity of the installation area.

9 Claims, 10 Drawing Sheets

39
24
16'
10
19
18
38

MARINE CAISSON BRACING SYSTEM AND METHOD OF INSTALLATION

TECHNICAL FIELD OF THE INVENTION

The present invention relates to a bracing system for bracing a marine caisson (conductor pipe) emanating from a water bottom and extending above the water level of a body of water, as well as a method of installation therefore. The system of the present invention allows the installation of a bracing structure without the necessity of a heavy lift boat, the present system utilizing a tugger or winch temporarily affixed preferably to the upper portion of the riser, or alternatively placed upon a nearby vessel such as a jack-up rig, or the barge upon which the brace is transported to the installation site.

In the preferred embodiment of the present invention, a bracing structure is provided in the form of an elongated bracing member having first and second ends, the first end having a pile sleeve for engaging the bottom, the second end having a doubler plate or the like for engaging the caisson above the water line. A pulley is provided on the caisson above the water line, in the vicinity of (preferably above) where the doubler plate is to be mounted on the caisson. A cable having first and second ends is provided, the first end affixed to the bracing member in the vicinity of the doubler plate, the second end engaging the tugger or winch, the cable passing through a first pulley in the vicinity of the installation area to guide the first end of the brace to the caisson. The present invention is illustrated as a single leg brace, but it is noted that two, three, or more legs are generally utilized to brace the conductor pipe in the manner illustrated in the present application.

In use, the tugger draws the cable so as to urge the doubler plate to the caisson above the water line in the vicinity of the installation area. A small crane may be utilized to urge the bracing into the water from the barge, without having to fully lift same, the small crane only partially supporting the bracing, so as to dispense with the necessity of a larger crane, and requisite larger vessel.

BACKGROUND OF THE INVENTION

While the prior art anticipates many and diverse minimal platform installation systems, none are believed to contemplate a system of installation with the ease and economy of the present invention.

U.S. Pat. No. 5,308,194 to Carruba issued 1994 teaches an "Offshore Support Structure Apparatus" wherein there are provided first and second, diagonal braces having first and second ends, the first, lower ends including pile sleeves to receive piles at the water bottom, the second, upper ends including a doubler plate configured to engage guide plates fixed to the Caisson, so that the doubler plate come in abutting relationship with the Caisson. See FIGS. 12–15.

U.S. Pat. 5,026,210 issued 1991 to Carruba teaches an "Offshore Support Structure Method and Apparatus" wherein a pivot support member is provided at the upper portion of the caisson to engage the upper portion of each brace at or above the waterline to aid in the installation of the brace.

U.S. Pat. No. 5,181,799 issued 1993 to Carruba is related to the above '210 patent, likewise teaching a support structure supported by only two legs having pile skirts spaced by a bracing member, the upper portions of the pile skirts connecting to the conductor pipe such that the bracing legs are "secured at their upper ends to the conductor pipe and the lower ends of the legs can be moved downwardly into contact with the ground".

U.S. Pat. No. 4000624 teaches a system whereby the conductor pipe is supported by bracing legs pivotally attached thereto under the waterline.

U.S. Pat. No. 4,818,145 to Carruba is the parent to the above Carruba patents '210 and '799, teaching a system employing a pivoting brace concept for installation.

British Patent 1,1 56,651 issued 1961 illustrates a "marine structure" utilizing first and second, pivotally attached braces to support same.

Thus, while the prior art teaches several systems having concepts incorporating bracing systems or the like for bracing a conductor pipe, caisson, or the like, none would appear to teach, suggest, or otherwise contemplate the system of the present invention.

GENERAL SUMMARY DISCUSSION OF THE INVENTION

The present invention provides a marine caisson bracing system which is more efficient to install, requires less heavy lifting equipment, and less personnel than the prior art.

Unlike the prior art cited above, the present invention allows the installation of a bracing structure without the necessity of a heavy lift boat, instead incorporating a tugger or winch temporarily affixed to the upper portion (or top) of the caisson. Alternatively, the winch could be situated removed from the caisson, via a cable pulley or the like situated in the upper section of the caisson .

A bracing structure is provided in the form of an elongated bracing member having first and second ends, the first end having a pile sleeve for engaging the bottom, the second end having a doubler plate or the like for engaging the caisson above the water line. A cable pulley is provided on the caisson above the water line, in the vicinity of where the doubler plate is to be mounted on the caisson. A cable having first and second ends is provided, the first end affixed to the bracing member in the vicinity of the doubler plate, cable passing through a first pulley situated on the caisson in the vicinity of the installation area, the second end engaging the tugger or winch.

In use, the tugger draws the cable so as to urge the doubler plate to the caisson above the water line in the vicinity of the installation area via the first pulley. A small crane may be utilized to urge the bracing into the water from the barge, without having to fully lift same, the small crane only partially supporting the bracing, so as to dispense with the necessity of a larger crane, and requisite larger vessel.

It is therefore an object of the present invention to provide a marine caisson bracing system and method for installation therefore which requires less heavy lifting apparatus than that contemplated by the prior art.

It is another object of the present invention to provide a system for bracing a marine caisson for the formation of a minimal platform utilizing a cable positioning method, which cable is guided by a first pulley mounted to the caisson and situated in the vicinity of the brace/caisson connection, and a second pulley or winch mounted to the caisson and situated above said first pulley.

It is another object of the present invention to provide a bracing system comprising a brace member having first and second ends, the first end including a pile sleeve configured to contact a water bottom, and a second end having a doubler plate configured to engage the caisson above the water line, the second end of the brace member further configured to engage a cable, said cable passing through said first pulley and second pulley, or winch, so as to facilitate the positioning of said second end of said brace adjacent to said caisson to support and reinforce same.

Lastly, it is an object of the present invention to provide a method and system for bracing and reinforcing a caisson via brace member, said brace member configured for positioning adjacent to a caisson for supporting a minimal platform utilizing a cable/pulley and winch system.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
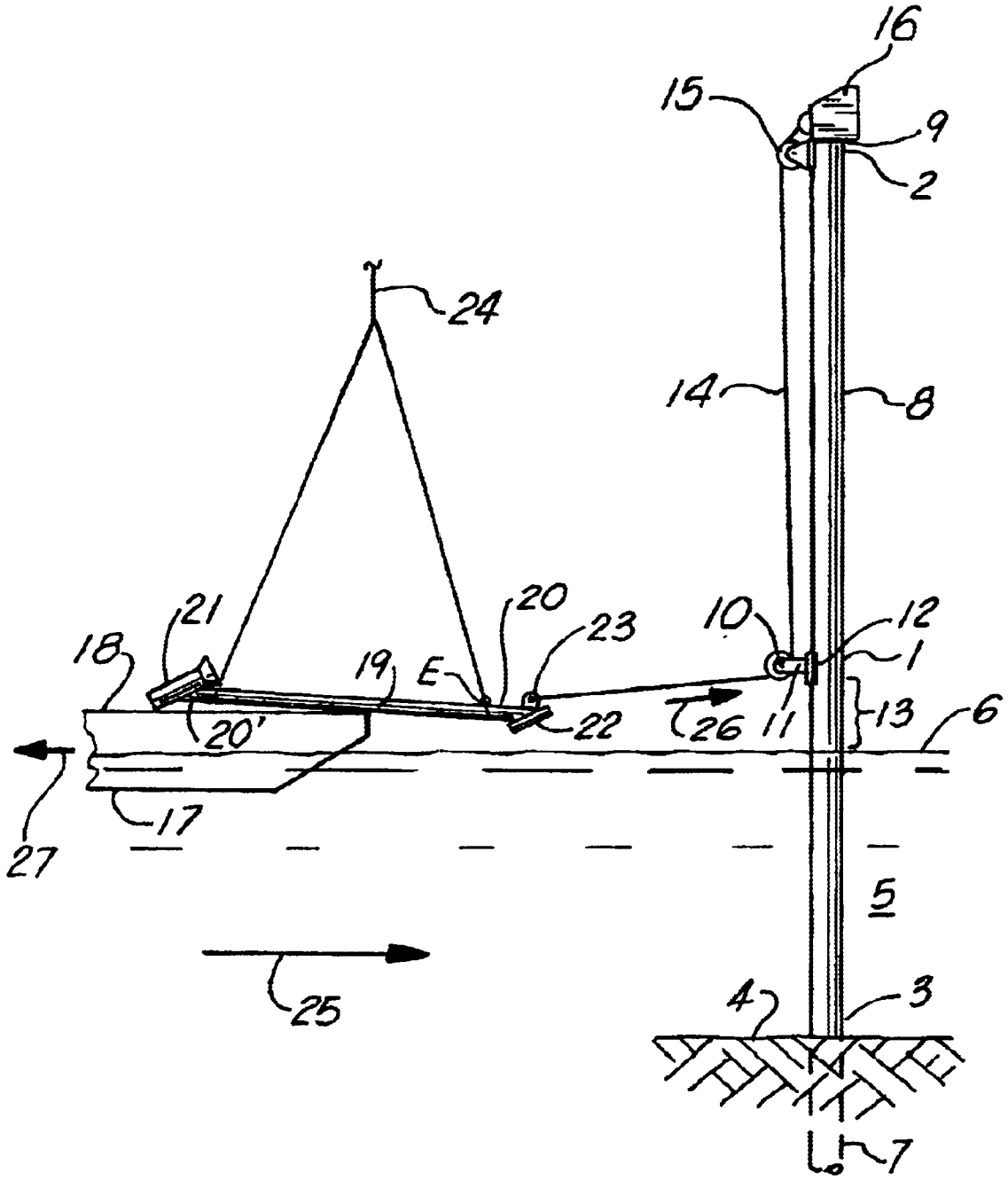
FIG. 1 is a side view of the method of installation of the preferred embodiment of the present invention, illustrating the caisson brace being urged to the caisson via cable/pulley/tugger arrangement.
Figure 3:
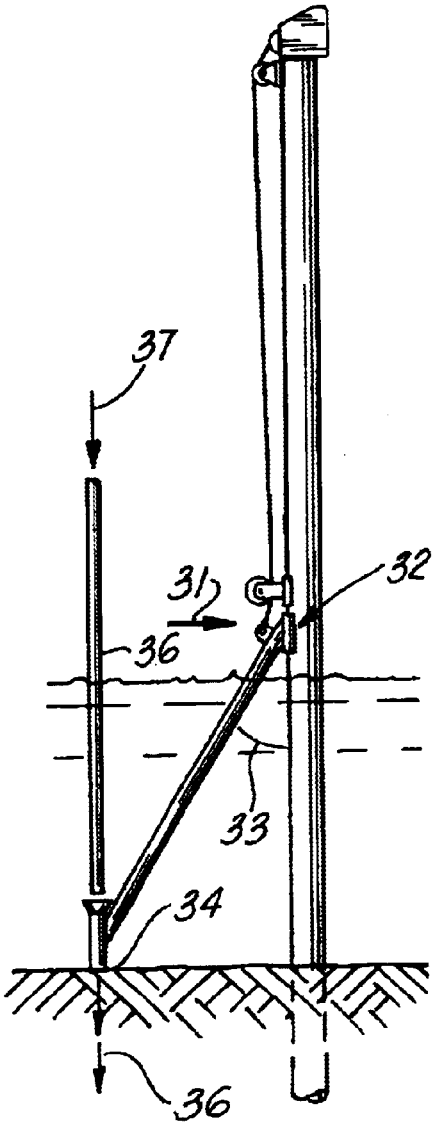
FIG. 3 is a side view of the invention of FIG. 1, illustrating the caisson brace positioned in place, with a pile ready to be driven.
Figure 2:
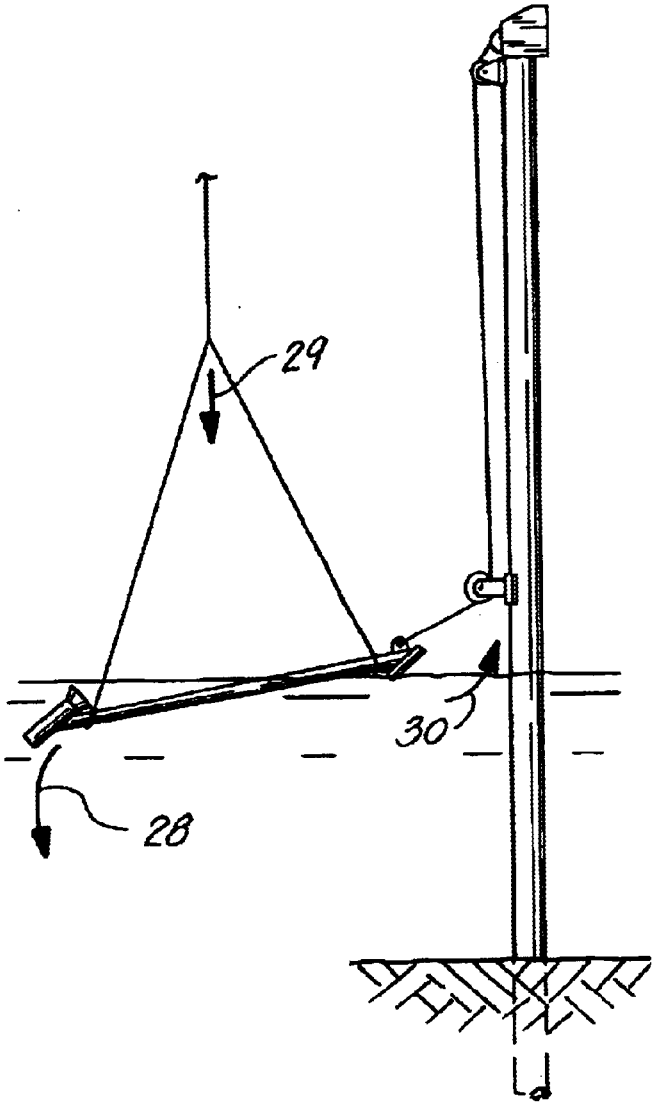
FIG. 2 is a side view of the invention of FIG. 1, illustrating the caisson brace partially submerged and buoyed by the water.

Referring to FIG. 1 of the drawings, the system of the present invention is provided to brace a conductor pipe, caisson 1 or the like for placement of a minimal platform or other structure thereupon, the caisson 1 having a first 2, upper end ending in a top 9, and a second 3, lower end, the first end situated above a water level 6 in a body 5 of water, the second end penetrating the water bottom 4, having been driven sub surface 7, the caisson further having an outer 8, generally radial, surface.

Figure 7:
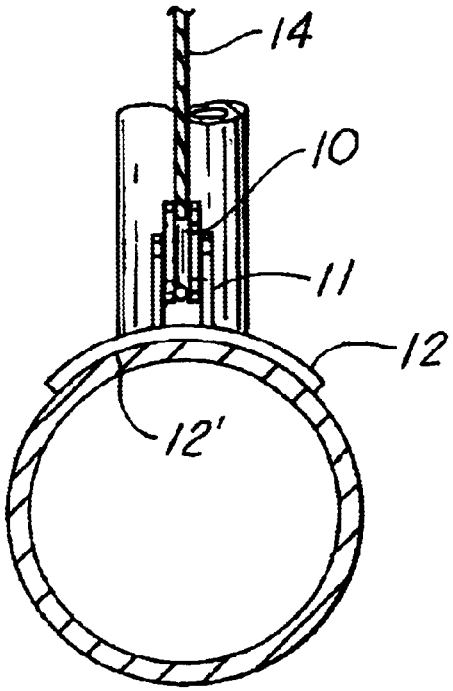
FIG. 7 is a top view of a single pulley embodiment of the invention of FIG. 6.

Continuing with FIGS. 1 and 7, a first pulley 10 is supported by a bracket 11, which is engaged to a doubler plate 12 having a contact surface 12' configured to engage the outer surface 8 of the caisson 1 above 13 the waterline in a predetermined position wherein the upper portion of the brace is to be engaged to the caisson below the first pulley. As shown, a cable 14 is provided which runs from the first 20 end of the brace 19, through the first pulley 10, through a second pulley 15 situated above the first pulley, and engaging a tugger 16, winch or the like situated at the upper end, or upon, the caisson. An exemplary tugger could be, for example, a 50 ton capacity as is used in the field, and could be welded or affixed to the caisson, or could have a base comprising a cap having a diameter configured to slip over and engage or cap the top of the caisson, or alternatively could comprise an insert having an outer diameter configured to engage the inner diameter of the caisson, so as to slip into the caisson open area and engage the inner diameter of same. Further, the second pulley 15 could be part of the tugger in a single unit, or the second pulley (or even the first pulley) may not be required in some installations.

Figure 10B:
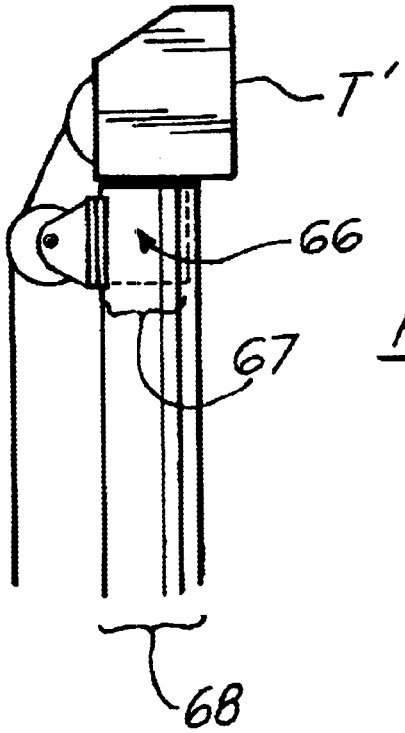
FIG. 10B is a side view of an alternative tugger/winch system for the present invention, wherein an insert is placed within the inner diameter of the caisson to facilitate a stable support upon the top of the caisson.
Figure 10A:
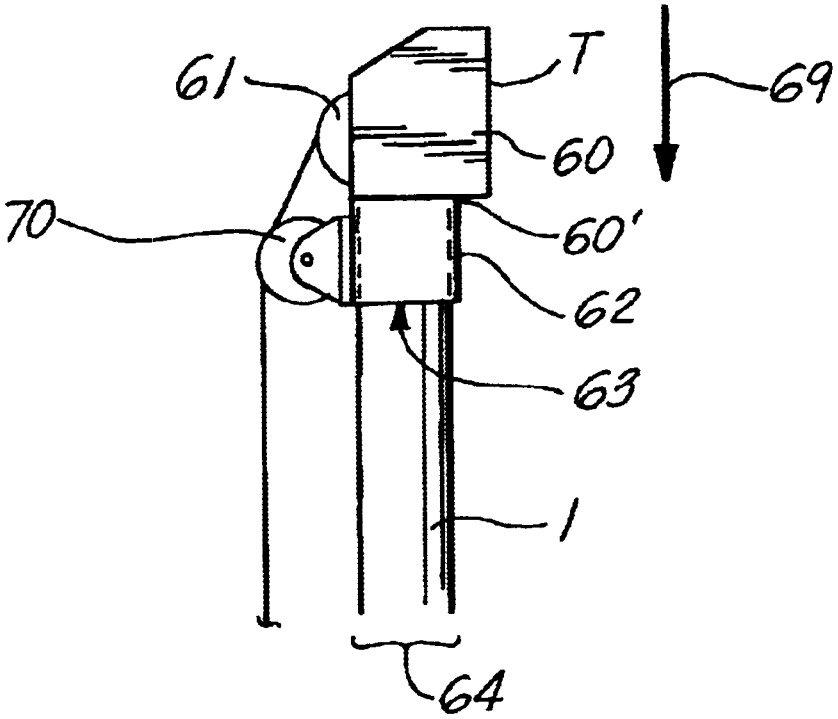
FIG. 10A is a side view of an exemplary tugger/winch system which may be used with the present invention, utilizing a cap which is placed over the outer diameter of the caisson to facilitate a stable support upon the top or the caisson.

Referring to FIGS. 10A and 10B, the tugger T comprises a housing 60 having a winch 61 situated therein, the housing sitting upon a base 60', the base engaging a cap 62 having an inner opening to receive the caisson, the inner diameter 63 of the cap being larger than the outer diameter 64 of the caisson, so that the cap may be placed upon 69 and envelope the top portion of the caisson, so that the base 60 may be supported upon the top of the caisson in stable fashion. A pulley 70 (which may be utilized as the second pulley 15 referenced above) may be attached to the exterior of the cap 62.

Alternatively, an insert member 66 having an outer diameter 67 less than the inner diameter 68 of the caisson may be provided emanating from the base of the tugger T', so that the insert may be placed within the inner diameter of the caisson, so as to allow the base of the tugger to be supported upon the top of the caisson in stable fashion.

Returning to FIGS. 1 and 7, a barge 17 is provided to convey the brace 19 to the installation site, the barge having a deck 18 upon which the brace is placed. The brace 19 has first 20 and second 20' ends, the second end having affixed thereto a piling sleeve 21 for receiving a piling therethrough to lodge the second end to the water bottom or floor, the first end having a doubler plate 22 configured to act as an engagement surface for engaging the outer surface of the caisson. A padeye 23 or other cable connection is provided at the first end of the brace opposite the doubler plate to receive the first end of cable 14, the cable being spooled though the first pulley 10, the second end engaging tugger 16.

Continuing with FIGS. 1, 2, 3, 7, and 9 a balanced lift line 24 is supported by a crane 39 which may be located upon, for example, a jack up barge 38 so as to support the brace 19. After the barge is positioned 25 in the vicinity of, but spaced from the caisson and near the installation area, cable 14 is engaged to the padeye 23 on brace, through pulley 10 and to tugger 16, so that the brace and barge are situated in spaced relationship from the caisson, the lift cable 24 supports the brace 19 via crane 39 while the barge 17 is conveyed 27 away from the caisson, allowing the cable 14 to prevent the brace from moving away with the barge so that the brace slides off of the deck 18 of the barge in a controlled fashion 29 via lift cable 24 and crane 39 and into 28 the water. Further, the tugger 16 could be engaged to urge 26 cable 14 and first end 20 of brace 19 generally toward the caisson 1. Preferably, the lift cable engages the ends of the brace via lifting eyes E to facilitate proper orientation of the brace vis a vis the caisson, once it is lifted from the deck of the barge.

Once in the water, the lift line continues to lower the brace in a controlled fashion 29, while the tugger 16 retracts cable 14, so as to urge 30 the doubler plate 12 under the first pulley 10, where it may be positioned 31 at the desired point and orientation 33.

The second end of the brace is lowered to the water bottom or sea floor, where a piling 36 is driven 37 through the pile sleeve and into 36 the water bottom, anchoring the second end of the brace, while the doubler plate 12 is affixed 32 to the caisson via welding, threaded fastener, cable, bracket, or the like. A mud mat may be provided where desirable to prevent sinking. Once fastened, the first and second pulleys (if used), and tugger may be removed, the bracing operation is completed, and a minimal platform or other structure may be installed upon the caisson in a reinforced fashion. It is reiterated that at least two generally laterally oriented braces are required to fully brace a caisson in most marine applications, so a second brace may be further required in addition to the above first brace, which second brace would be installed in a similar matter following the first brace, but laterally situated relative to the first brace.

Figure 8:
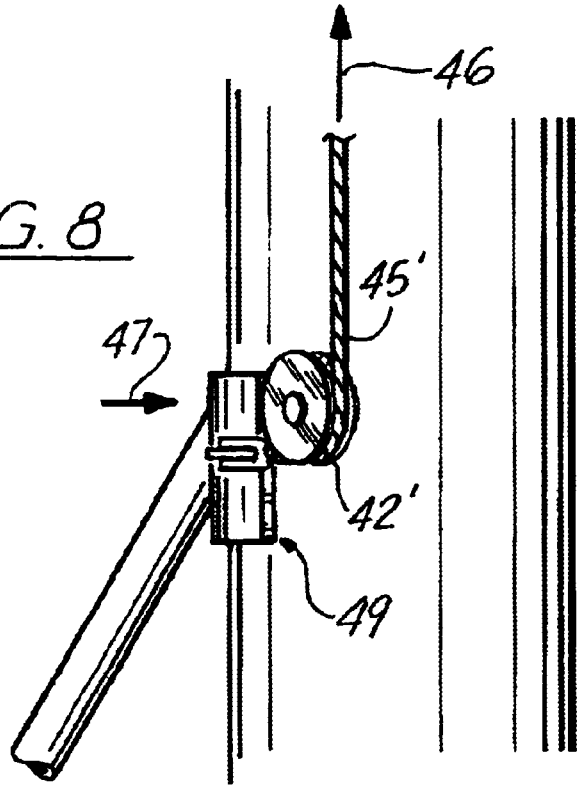
FIG. 8 is an isometric view of the pulley embodiment of FIG. 6.
Figure 6:
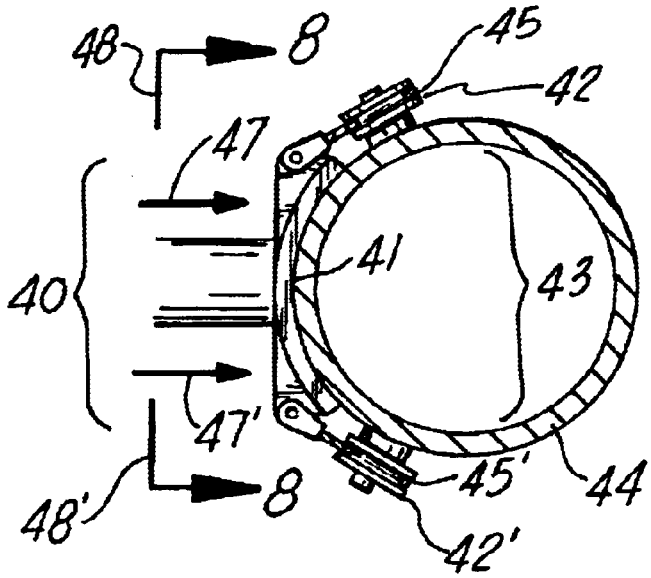
FIG. 6 is a top view of a dual pulley arrangement for urging the upper portion of the caisson brace to the correct installation position on the caisson.

FIGS. 6 and 8 illustrate an alternative first pulley system 40 wherein a doubler plate 41 having a width 41' commensurate with a caisson 44 so as to communicate same is urged to the appropriate installation position via first 42 and second 42' pulleys conveying first 45 and second 45' cables, respectively, the pulleys 42, 42' situated on the caisson 44 in spaced relationship 43 about opposing sides of the doubler plate. Instead of pulling the doubler plate to a position below the pulley, as is taught in the first embodiment of the first pulley (shown in FIG. 7), in the alternative embodiment of FIGS. 6 and 8 the doubler plate pulled 46 by the opposing cables and urged 47, 47' flush between 48, 48' the pulleys, where the doubler plate may be affixed 49 to the caisson.

Figure 4:
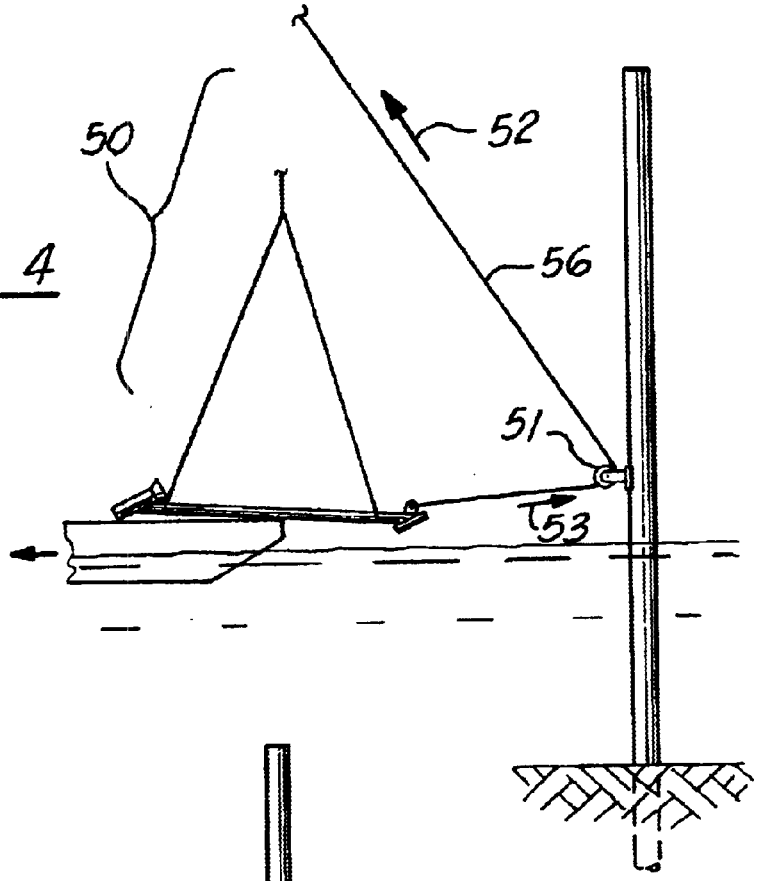
FIG. 4 illustrates a side view of an alternative embodiment of the present invention, wherein a winch is used on a vessel to tug the cable so as to position the caisson brace in place.
Figure 5:
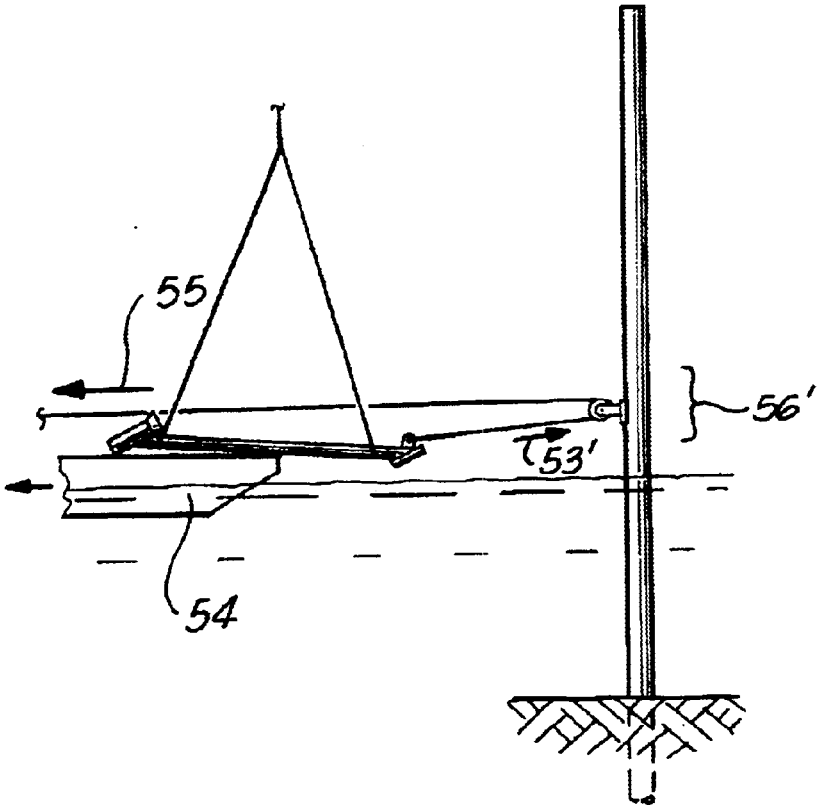
FIG. 5 illustrates a side view of the invention of FIG. 4, wherein the barge supporting the caisson brace is backed from the vicinity from the caisson so as to urge the brace into the water, dispensing with the necessity of a heavy lift crane.
Figure 9:
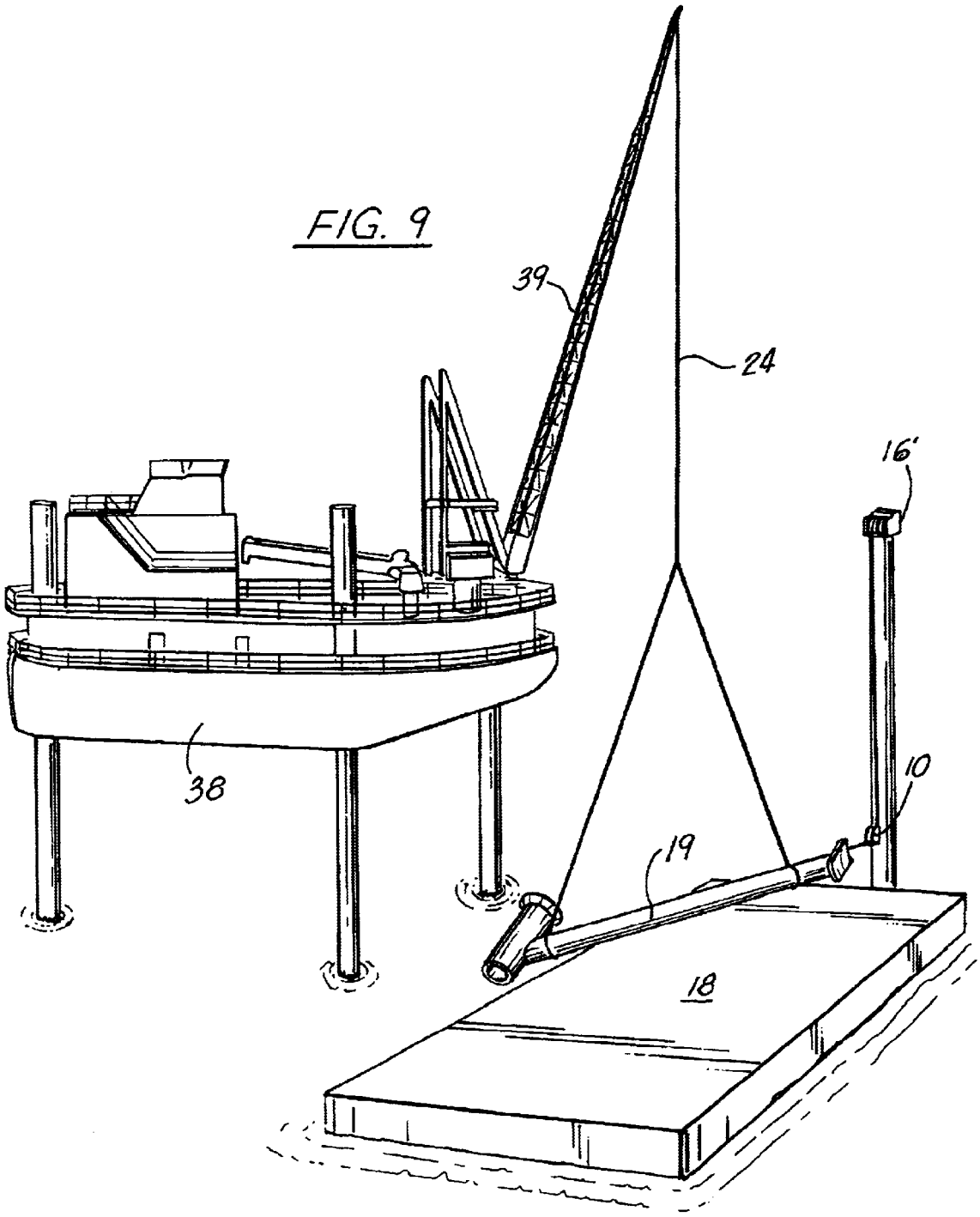
FIG. 9 is an isometric view the preferred embodiment of the invention, illustrating a jack-up barge crane lifting the caisson brace from the barge, with the upper portion of the caisson brace being guided to the installation area on the caisson via a cable which runs through a lower pulley, which is powered by a top mounted tugger, which is mounted to the upper outer portion or atop the caisson.

FIGS. 4 and 5 illustrates second 50 and third 56' embodiments of the present invention, which utilize a winches provided on separate vessels, as opposed to the tugger situated atop the caisson, as in the first embodiment of FIGS. 1 and 9. As shown, a first pulley 51 is provided as is utilized in the preferred embodiment, but the cable is deployed to a remote tugger, winch, or the like, which may be located on a separate vessel (as shown in FIG. 4), or may be provided on the barge 54 deploying the brace (FIG. 5)., each respectively urging 52, 55 the first end of the brace towards 53, 53' the first pulley 51 during the installation operation. As in the preferred embodiment, a lift cable 50 may be utilized to support the brace as it is urged from the barge.

Figure 11A:
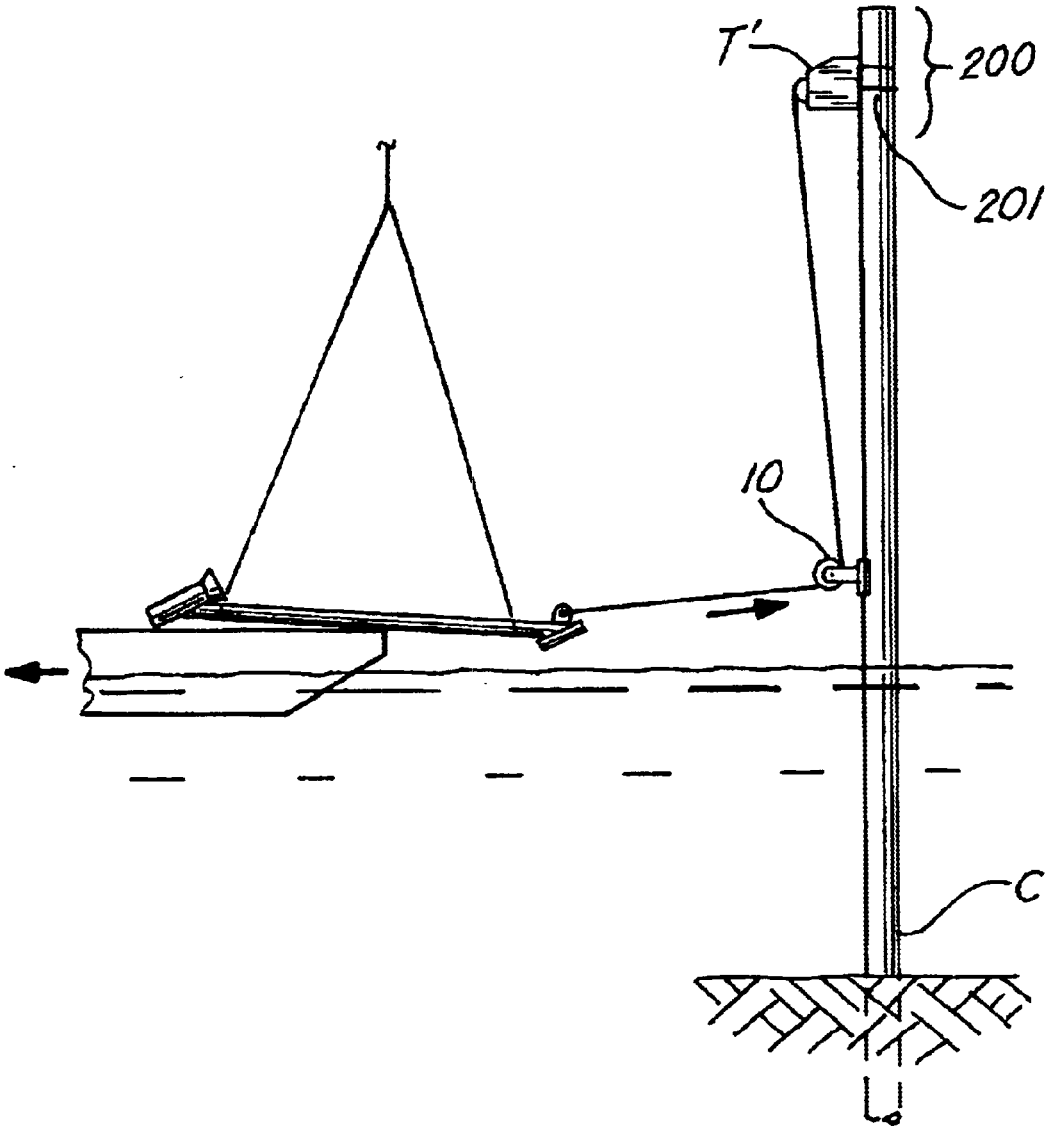
FIG. 11A is a side view of an second embodiment of an exemplary tugger/winch system which may be used with the present invention, utilizing a bracelet which is mounted about the outer diameter of the caisson to facilitate a stable support from the upper portion of the caisson.
Figure 12B:
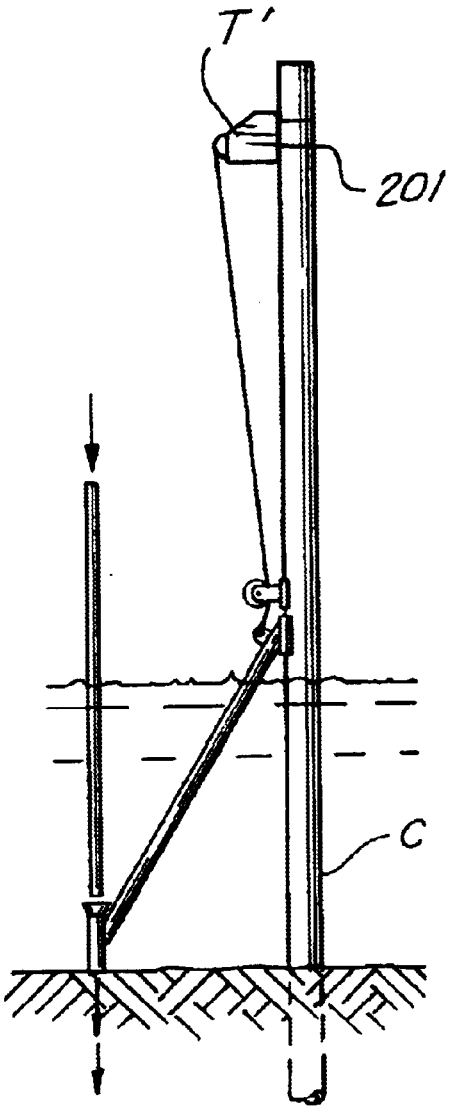
FIG. 12B is a side view of the invention of FIG. 11A, illustrating the caisson brace positioned in place, with a pile ready to be driven.
Figure 12A:
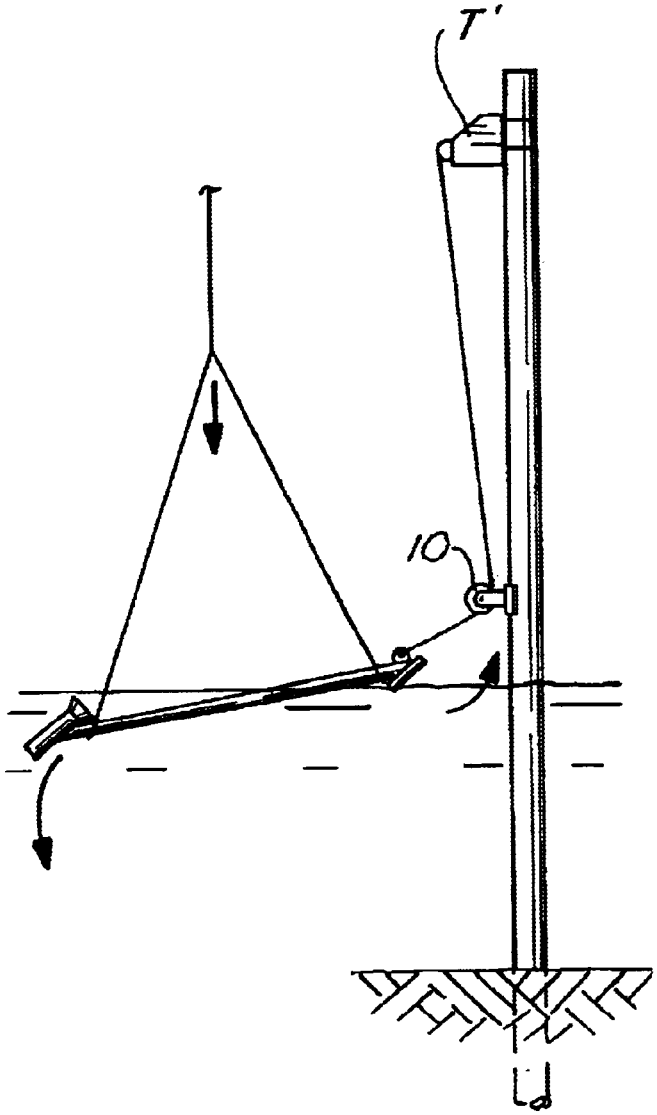
FIG. 12A is a side view of the invention of FIG. 11A, illustrating the caisson brace partially submerged and buoyed by the water.

Continuing with FIGS. 11A 12A, and 12B, a fourth alternative embodiment to the invention of FIG. 1 comprises a tugger T' mounted to the outer surface of the caisson C above the water level, and preferably in the upper portion 200 of the caisson. As shown, the tugger is preferably temporarily mounted to the outer surface of the caisson via a chain binder, come-along, heavy duty bracelet 201 or the like, which is tightened about the outer periphery of the caisson to frictionally retain the tugger in place during lifting operations. Other methods of mounting the tugger could include a bracket or engagement slot affixed to the outer surface of the caisson, or the like.

As shown, the tugger operates similarly to the system of FIG. 1, except that it does not rest upon the top, or engage the interior of the caisson. Further, the upper, second pulley (15 in FIG. 1) is not required, as is also the case with the preferred embodiment of the invention.

FIGS. 11A, 12A and 12B illustrates the fourth alternative embodiment utilizing the lower, first pulley 10, and, other than the installation and mounting location of the tugger, the system is implemented in use and works in a manner consistent with the teachings of the preferred embodiment of FIG. 1.

Figure 11B:
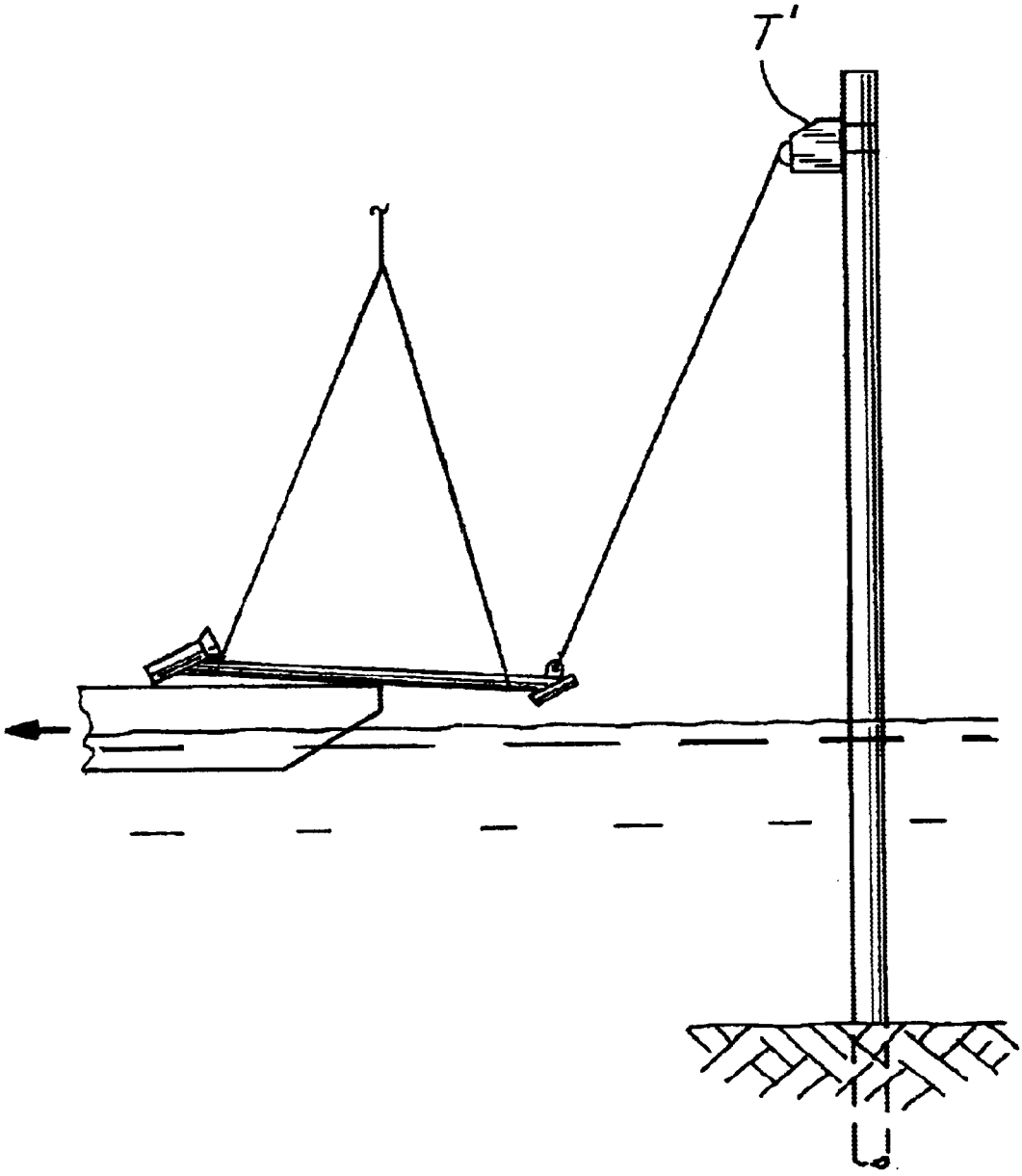
FIG. 11B is a side view of the invention of FIG. 11A, but illustrating installation of an exemplary brace installation system without the need for a second, lower pulley.

FIG. 11B illustrates a fifth alternative embodiment of the invention of FIG. 1, wherein the upper and lower pulleys (10 and 15 in FIG. 1) are not installed to the caisson, and wherein the tugger T' is affixed to the caisson in the manner contemplated in FIG. 11A.

Figure 13B:
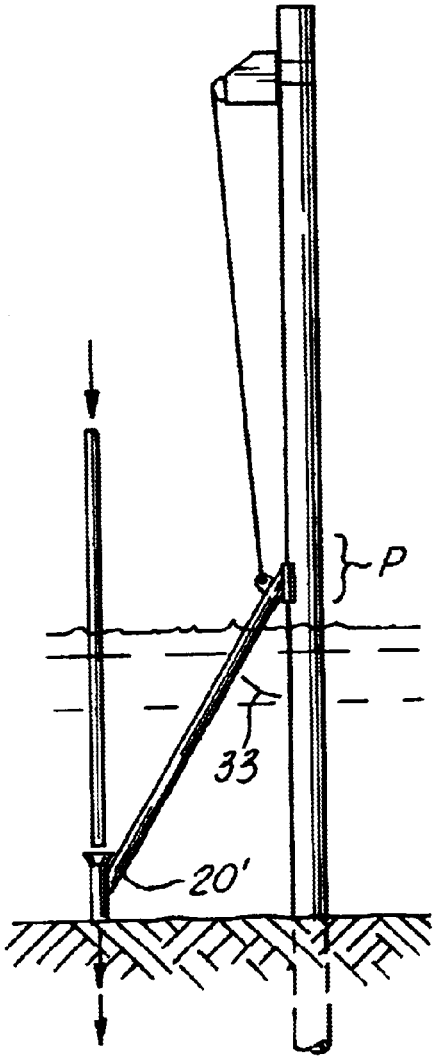
FIG. 13B is a side view of the invention of FIG. 11B, illustrating the caisson brace positioned in place, with a pile ready to be driven.
Figure 13A:
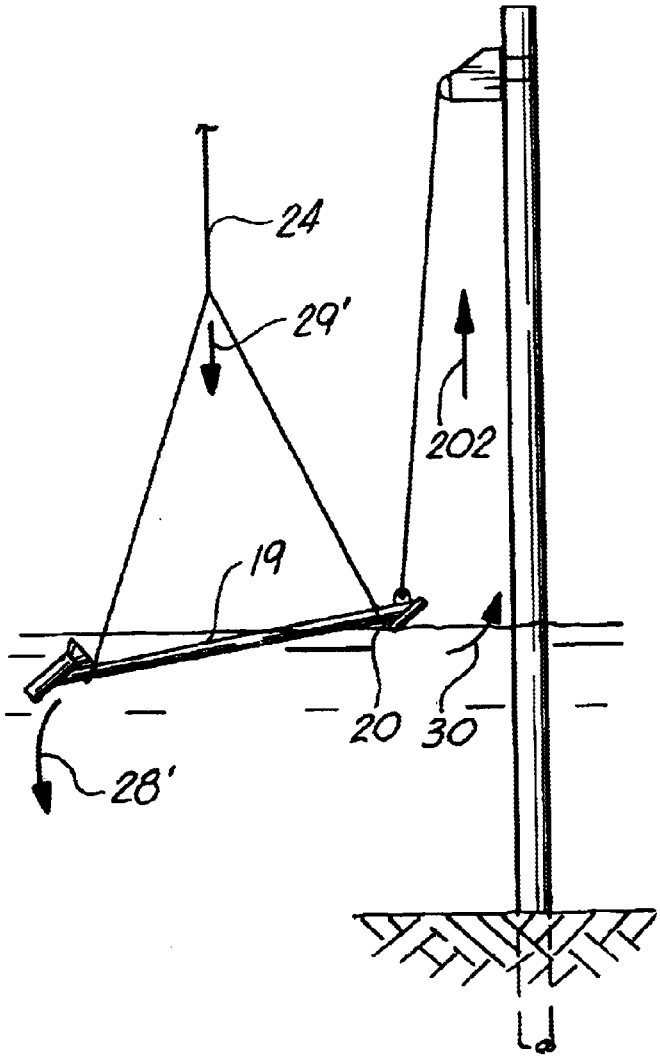
FIG. 13A is a side view of the invention of FIG. 11B, illustrating the caisson brace partially submerged and buoyed by the water.

Continuing with FIGS. 11A, 13A and 13B, the tugger T' lifts the first end 20 of the brace 19 without the first and/or second pulleys of the earlier embodiments so as to urge 30 the first end of the brace at the desired installation point P on the caisson, and at the desired point and orientation 30. Further, during installation, the lifting 202 of the first end 20 of the brace, in addition to urging the first end to the installation area or point, also facilitates the lowering 28' of the second end of the brace to the sea floor, where the second end 20' can be positioned via balanced lift line 24. Other than the mounting position of the tugger and the lack of first and/or second pulleys independently mounted to the caisson, this embodiment otherwise works in a manner consistent with the principle embodiment of the invention.

In conclusion, the method of the preferred embodiment of the present invention may be summarized as follows:

a) providing a brace comprising first and second ends, the first end having a doubler plate affixed thereto, said doubler plate having a contact surface configured to engage the outer surface of the marine caisson, the second end having a pile sleeve for receiving a pile;

b) a first pulley may be affixed upon the caisson above the water level, if desired;

c) providing a tugger comprising:

mounting means for mounting the tugger in the vicinity of the upper or top portion of the caisson so as to securely support said cap upon the top of said caisson;

d) affixing said mounting means of said tugger to the upper portion or top of said caisson above said first pulley, securely supporting said tugger upon upper portion or top of said caisson;

e) transporting said brace to the vicinity of said caisson;

f) providing a cable having first and second ends;

g) affixing said first end of said cable to said first end of said brace, passing said cable through said first pulley, and engaging said second end of said cable to said tugger;

h) engaging said tugger so as to retract said cable, urging the first end of said brace under said first pulley such that said contact surface of said doubler plate engages the outer surface of said brace below said first pulley, providing an engaged doubler plate;

i) affixing said doubler plate to said caisson;

j) driving a pile through said pile sleeve at said second end of said brace, affixing said second end of said brace to the water bottom; and k) removing said tugger from said caisson.

It is reiterated that the above system teaches the installation of a single brace for illustrative purposes, but typically two, three, four or more piles may be installed to sufficiently brace a caisson or other vertical support in a marine or other environment.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A method of bracing a marine caisson situated in a body of water having a water bottom and a water level, the marine caisson having first and second ends, the first end situated above the water level of the body of water and the second end situated in the water bottom, the marine caisson further having an outer surface and a top, the method comprising the steps of:

a) providing a brace comprising first and second ends, the first end having a doubler plate affixed thereto, said doubler plate having a contact surface configured to engage the outer surface of the marine caisson, the second end having a pile sleeve for receiving a pile;

b) affixing a first pulley upon the caisson above the water level;

c) slidingly engaging a tugger upon said caisson above said first pulley;

d) transporting said brace to the vicinity of said caisson;

e) providing a cable having first and second ends;

f) affixing said first end of said cable to said first end of said brace, passing said cable through said first pulley, and engaging said second end of said cable to said tugger;

g) engaging said tugger so as to retract said cable, urging the first end of said brace under said first pulley such that said contact surface of said doubler plate engages the outer surface of said caisson below said first pulley, providing an engaged doubler plate;

h) affixing said doubler plate to said caisson;

i) driving a pile through said pile sleeve at said second end of said brace, affixing said second end of said brace to the water bottom; and j) removing said tugger from said caisson.

2. A method of bracing a marine caisson situated in a body of water having a water bottom and a water level, the marine caisson having first and second ends, the first end situated above the water level of the body of water and the second end situated in the water bottom, the marine caisson further having an outer surface and a top, the method comprising the steps of:

a) providing a brace comprising first and second ends, the first end having a doubler plate affixed thereto, said doubler plate having a contact surface configured to engage the outer surface of the marine caisson, the second end having a pile sleeve for receiving a pile;

b) affixing a first pulley upon the caisson above the water level;

c) providing a tugger comprising:

i. a cap having an inner diameter greater than the outer diameter of the caisson, said cap configured to be placed upon and envelope the top of the caisson so as to securely support said cap upon the top of said caisson;

ii. a base engaged to said cap, said base supporting said tugger; and d) slidingly affixing said cap of said tugger upon the top of said caisson above said first pulley, so that said cap envelopes the top of the caisson, securely supporting said tugger upon the top of said caisson;

e) transporting said brace to the vicinity of said caisson;

f) providing a cable having first and second ends;

g) affixing said first end of said cable to said first end of said brace, passing said cable through said first pulley, and engaging said second end of said cable to said tugger;

h) engaging said tugger so as to retract said cable, urging the first end of said brace under said first pulley such that said contact surface of said doubler plate engages the outer surface of said caisson below said first pulley, providing an engaged doubler plate;

i) affixing said doubler plate to said caisson;

j) driving a pile through said pile sleeve at said second end of said brace, affixing said second end of said brace to the water bottom; and k) removing said tugger from said caisson.

3. A method of bracing a marine caisson situated in a body of water having a water bottom and a water level, the marine caisson having first and second ends, the first end situated above the water level of the body of water and the second end situated in the water bottom, the marine caisson further having an outer surface and a top, and a passage formed longitudinally therethrough having an inner diameter, the method comprising the steps of:

a) providing a brace comprising first and second ends, the first end having a doubler plate affixed thereto, said doubler plate having a contact surface configured to engage the outer surface of the marine caisson, the second end having a pile sleeve for receiving a pile;

b) affixing a first pulley upon the caisson above the water level;

c) providing a tugger comprising:

i. an insert having an outer diameter less than the inner diameter of the passage formed through caisson, said insert configured to be placed within and be received by the open passage formed through the caisson to as to securely support said tugger;

d) slidingly placing said insert into said open area formed in the caisson so as to securely support said tugger upon the top of said caisson;

e) transporting said brace to the vicinity of said caisson;

f) providing a cable having first and second ends;

g) affixing said first end of said cable to said first end of said brace, passing said cable through said first pulley, and engaging said second end of said cable to said tugger;

h) engaging said tugger so as to retract said cable, urging the first end of said brace under said first pulley such that said contact surface of said doubler plate engages the outer surface of said caisson below said first pulley, providing an engaged doubler plate;

i) affixing said doubler plate to said caisson;

j) driving a pile through said pile sleeve at said second end of said brace, affixing said second end of said brace to the water bottom; and k) removing said tugger from said caisson.

4. A method of bracing a support member vertically emanating from the ground, the support member having first and second ends, the support member further having an outer surface and a top, the method comprising the steps of:

a) providing a brace comprising first and second ends, the first end having a contact surface configured to engage the outer surface of the support member;

b) providing a tugger comprising:

a cap having an inner diameter greater than the outer diameter of the support member, said cap configured to be placed upon and envelope the top of the support member so as to securely support said cap upon the top of said support member;

c) slidingly affixing said cap of said tugger upon the top of said support member, so that said cap envelopes the top of the support member, securely supporting said tugger upon the top of said support member;

d) providing a cable having first and second ends;

e) affixing said first end of said cable to said first end of said brace, and engaging said second end of said cable to said tugger;

f) engaging said tugger so as to retract said cable so as to urge the contact surface of said brace against said outer surface of said support member below said tugger, providing an engaged engagement surface;

g) affixing said engaged engagement surface to said support member;

h) anchoring said second end of said brace to the ground; and i) removing said tugger from the top of said support member.

5. The method of claim 4, wherein said tugger comprises a winch.

6. A method of bracing a marine caisson situated in a body of water having a water bottom and a water level, the marine caisson having first and second ends, the first end situated above the water level of the body of water and the second end situated in the water bottom, the marine caisson further having an outer surface and a top, the method comprising the steps of:

a) providing a brace comprising first and second ends, the first end having a doubler plate affixed thereto, said doubler plate having a contact surface configured to engage the outer surface of the marine caisson, the second end having a pile sleeve for receiving a pile;

b) affixing a first pulley upon the caisson above the water level;

c) providing a winch in the vicinity of said first pulley;

d) transporting said brace to the vicinity of said caisson;

e) providing a cable having first and second ends;

f) affixing said first end of said cable to said first end of said brace, passing said cable through said first pulley, and engaging said second end of said cable to said winch;

g) engaging said winch so as to retract said cable, urging the first end of said brace under said first pulley such that said contact surface of said doubler plate engages the outer surface of said caisson below said first pulley, providing an engaged doubler plate;

h) affixing said doubler plate to said caisson;

i) driving a pile through said pile sleeve at said second end of said brace, affixing said second end of said brace to the water bottom.

7. A method of bracing a marine caisson situated in a body of water having a water bottom and a water level, the marine caisson having first and second ends, the first end situated above the water level of the body of water and the second end situated in the water bottom, the marine caisson further having an outer surface and a top, the method comprising the steps of:

a) providing a brace comprising first and second ends, the second end having a pile sleeve for receiving a pile;

b) affixing a tugger upon said caisson above the water level;

c) transporting said brace to the vicinity of said caisson;

d) providing a cable having first and second ends;

e) affixing said first end of said cable to said first end of said brace, and engaging said second end of said cable to said tugger;

f) engaging said tugger so as to retract said cable, urging the first end of said brace against the outer surface of said caisson above the water level;

g) affixing said first end of said brace to said caisson;

h) driving a pile through said pile sleeve at said second end of said brace, affixing said second end of said brace to the water bottom; and i) removing said tugger from said caisson.

8. A method of bracing a marine caisson situated in a body of water having a water bottom and a water level, the marine caisson having first and second ends, the first end situated above the water level of the body of water and the second end situated in the water bottom, the marine caisson further having an outer surface and a top, the method comprising the steps of:

a) providing a brace comprising first and second ends, the first end having a doubler plate affixed thereto, said doubler plate having a contact surface configured to engage the outer surface of the marine caisson, the second end having a pile sleeve for receiving a pile;

b) affixing a tugger to the caisson above the water level;

c) transporting said brace to the vicinity of said caisson;

d) providing a cable having first and second ends;

e) affixing said first end of said cable to said first end of said brace, and engaging said second end of said cable to said tugger;

f) engaging said tugger so as to retract said cable, urging the first end of said brace under a first pulley attached to the caisson such that said contact surface of said doubler plate engages the outer surface of said caisson above the water line, providing an engaged doubler plate;

g) affixing said doubler plate to said caisson;

h) driving a pile through said pile sleeve at said second end of said brace, affixing said second end of said brace to the water bottom; and i) removing said tugger from said caisson.

9. A method of bracing a support member vertically emanating from the ground, the support member having first and second ends, the support member further having an outer surface and a top, the method comprising the steps of:

a) providing a brace comprising first and second ends, the first end having a contact surface configured to engage the outer surface of the support member;

b) discerning where on the support member the contact surface said bracing member is to be affixed to the support member, providing a discerned engagement area;

c) affixing a tugger to the outer surface of said support member above said discerned engagement area;

d) providing a cable having first and second ends;

e) affixing said first end of said cable to said first end of a bracing member, and engaging said second end of said cable to said tugger;

f) engaging said tugger so as to retract said cable so as to urge the contact surface of said bracing member against said outer surface of said support member below said tugger, providing an engaged engagement surface;

g) affixing said engaged engagement surface to said support member;

h) anchoring said second end of said brace to the ground; and i) removing said tugger from the top of said support member.

* * * * *